United States Patent [19]

Stewart et al.

[11] Patent Number: 5,000,196

[45] Date of Patent: Mar. 19, 1991

[54] METHOD AND APPARATUS FOR RECOVERING TOBACCO FROM IMPERFECT CIGARETTES

[75] Inventors: Iain Stewart, Ennepetal-Voerde; Alfred Brinker, Gevelsberg, both of Fed. Rep. of Germany

[73] Assignee: Maschinenfabrik Fr. Niepmann GmbH & Co., Gevelsberg, Fed. Rep. of Germany

[21] Appl. No.: 437,975

[22] Filed: Nov. 16, 1989

[30] Foreign Application Priority Data

Nov. 23, 1988 [DE] Fed. Rep. of Germany ..... 3839431

[51] Int. Cl.[5] ..... A24C 1/04

[52] U.S. Cl. ..... 131/96

[58] Field of Search ..... 131/96

[56] References Cited

U.S. PATENT DOCUMENTS

| | | | |
|---|---|---|---|
| 4,278,100 | 7/1981 | Thatcher | 131/96 |
| 4,763,673 | 8/1988 | Barnes et al. | 131/96 |
| 4,867,179 | 9/1989 | Leonard | 131/96 |

FOREIGN PATENT DOCUMENTS

| | | |
|---|---|---|
| 1250320 | 9/1967 | Fed. Rep. of Germany . |
| 2032706 | 1/1972 | Fed. Rep. of Germany . |
| 3301030 | 7/1983 | Fed. Rep. of Germany . |
| 2103360 | 4/1972 | France . |
| 2236431 | 2/1975 | France . |

*Primary Examiner*—V. Millin
*Assistant Examiner*—Jennifer L. Doyle
*Attorney, Agent, or Firm*—Robert W. Becker

[57] ABSTRACT

A method and apparatus for recovering tobacco from imperfect cigarettes that are ejected downstream of a cigarette-producing machine and are supplied to a recovery apparatus for opening the paper casings and separating the tobacco from the paper pieces and any filters that are present. The imperfect cigarettes of a given cigarette-producing machine are continuously supplied to an in-line recovery apparatus, which has a space-saving configuration, is coordinated to the output of the cigarette-producing machine, and is mounted adjacent thereto. Varying quantities of imperfect cigarettes are collected within the recovery apparatus, which is equipped with a rotary conveyer. A uniform stream of the recovered tobacco is returned to the cigarette-producing machine.

15 Claims, 5 Drawing Sheets

12
12b
11a
11
8
4
3
10

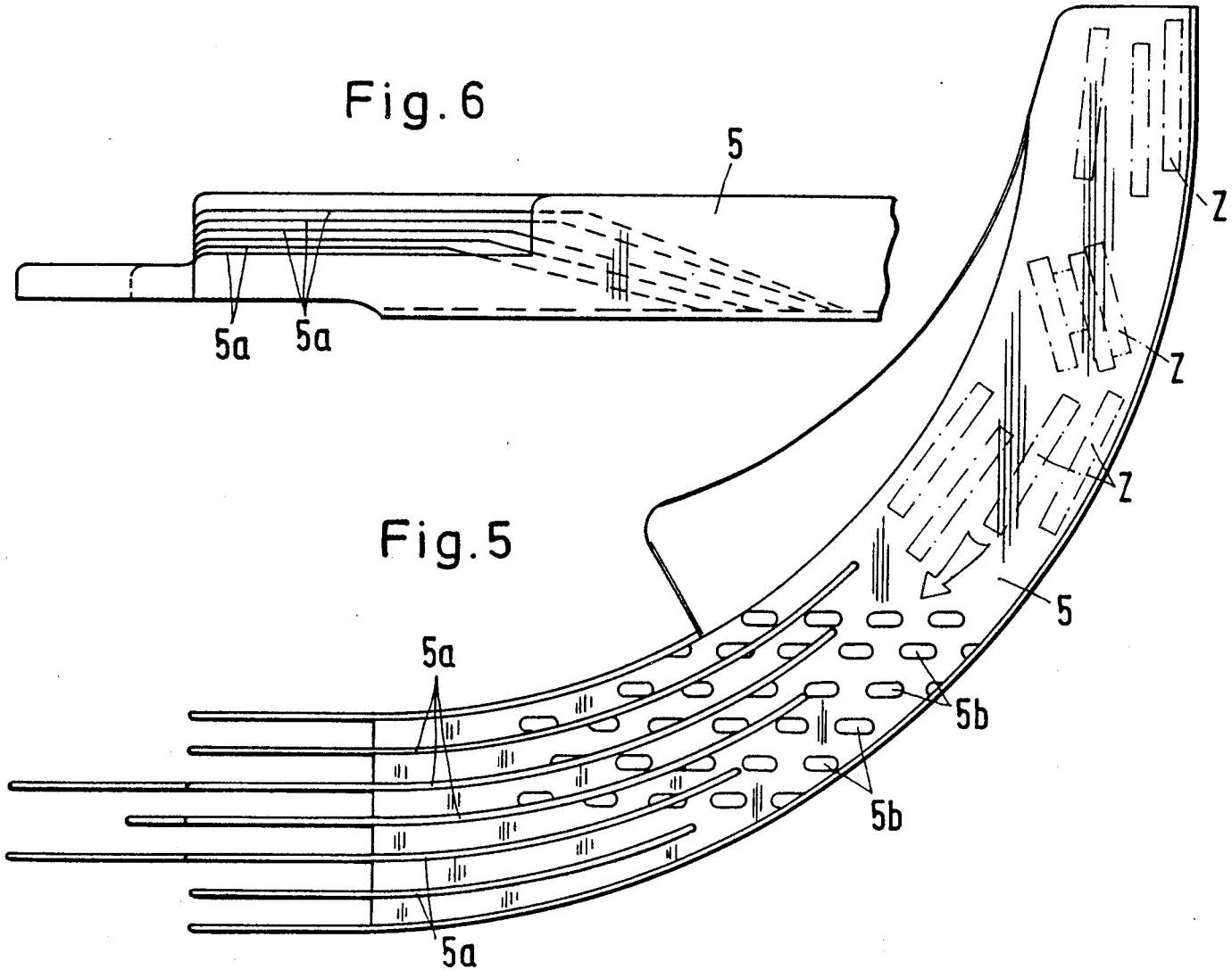
Fig. 6
Fig. 5
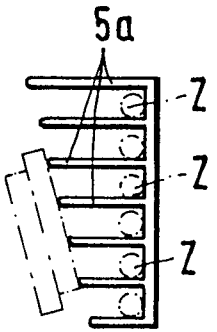
Fig. 7

METHOD AND APPARATUS FOR RECOVERING TOBACCO FROM IMPERFECT CIGARETTES

BACKGROUND OF THE INVENTION

The present invention relates to a method and apparatus for recovering tobacco from defective or imperfect cigarettes, which are separated-out downstream of the cigarette-producing machine and are supplied to a recovery apparatus for destroying the paper casings as well as for separating the tobacco from the paper pieces and from any filters that are present, with the tobacco that is recovered being returned, together with fresh tobacco, to the cigarette-producing machine.

When cigarettes are being manufactured, imperfect cigarettes coming from the maker or filter-tipper machines are automatically separated out, collected, and split-open in central units. The tobacco is separated from the paper and filters that remain, and is supplied back to the cigarette-producing machines along with fresh tobacco.

Various centralized facilities for recovering tobacco are known that are always large-scale facilities where the imperfect cigarettes from several cigarette-producing machines are processed. Thus, for example, it is known to distribute the imperfect cigarettes on a rotating disk on which, via centrifugal force, the cigarettes are transported to the edge of the disk and are thereby radially aligned; the thus-aligned cigarettes are conducted past small circular saw disks that slit open the paper casings. With another known system, the cigarettes are accelerated outwardly over several disks that are mounted on a vertical shaft, and are ripped open via fixed blades or blade heads on a cylinder wall. Finally, it is known to axially align the imperfect cigarettes via a vibrating chute and to supply them to a roller system, with the cigarettes being slit open between the rollers thereof.

All of the known, previously described systems have the drawback that cigarettes with different types of tobacco are collected separately and must be stored, which involves an undesired transport and storage effort. In addition, cigarettes having different types of tobacco must be processed in batches, as a result of which, depending upon the respective production planning for specific types of tobacco, longer storage times can be involved prior to recovery of the respective type of tobacco; this involves a not inconsiderable tying-up of capital. Finally, the heretofore known methods have the drawback that due to the storage, the tobacco dries out, so that during the subsequent reprocessing the valuable long-fiber portions of the tobacco are damaged in the recovery apparatus. As a result, the quality is adversely affected, and the proportion of recovered tobacco that can be processed with fresh tobacco is reduced.

It is an object of the present invention to provide a method and apparatus of the aforementioned general type to recover tobacco from imperfect cigarettes, whereby the aforementioned drawbacks are avoided and an immediate recovery of tobacco is made possible without having to accept damage to the quality of the recovered tobacco.

BRIEF DESCRIPTION OF THE DRAWINGS

This object, and other objects and advantages of the present invention, will appear more clearly from the following specification in conjunction with the accompanying schematic drawings, in which:

FIG. 5 is an enlarged plan view of the outlet means of the rotary conveyer of the inventive apparatus;

FIG. 6 is a side view of the outlet means of FIG. 5; and

FIG. 7 is an end view of the outlet means of FIGS. 5 and 6.

SUMMARY OF THE INVENTION

Figure 1:
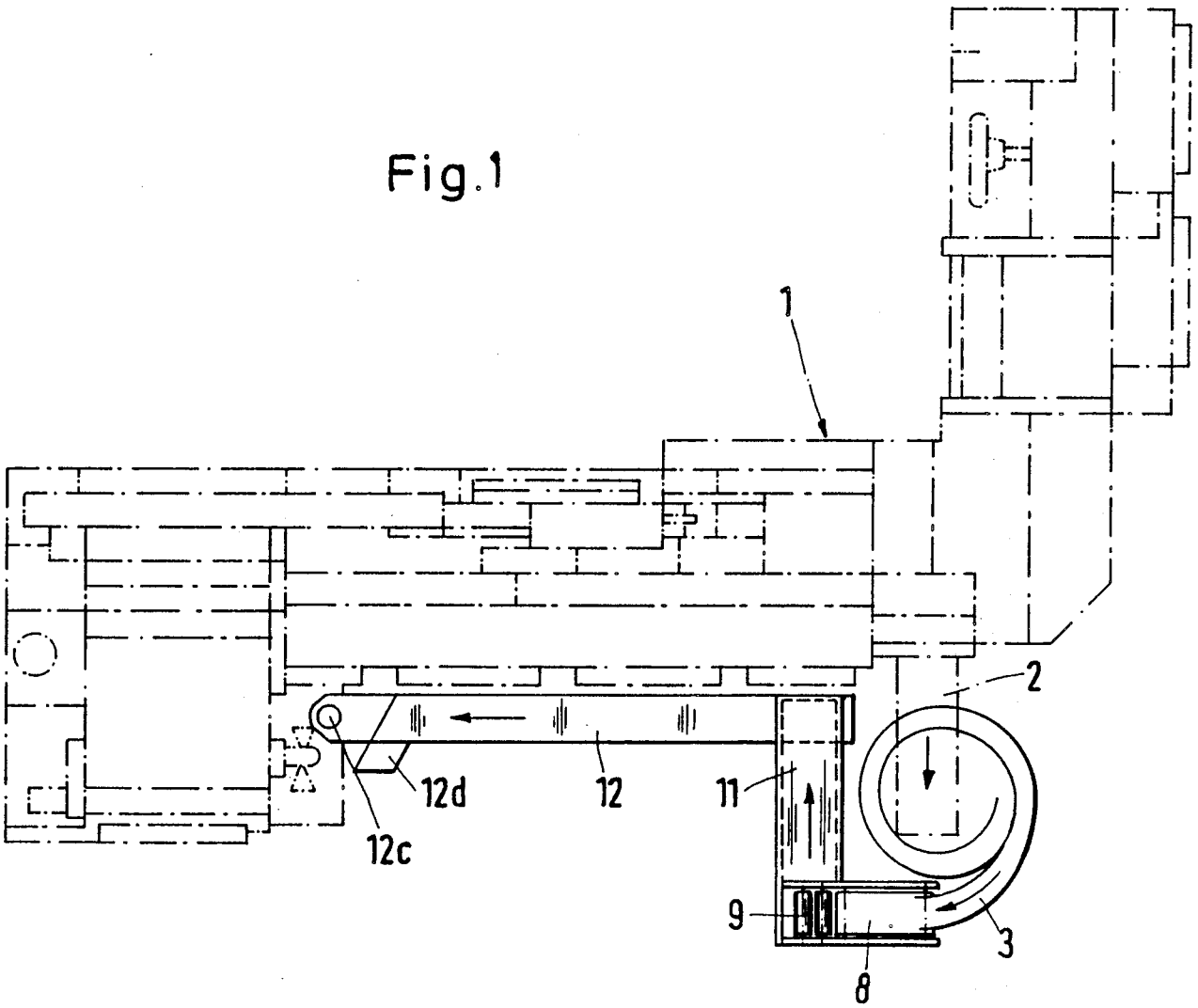
FIG. 1 is a plan view of a cigarette-producing machine, which is shown in dot-dash lines, and one exemplary embodiment of the apparatus of the present invention.

The method of the present invention is characterized primarily by the steps of: continuously supplying imperfect cigarettes from a given cigarette-producing machine to its own recovery apparatus, which has a space-saving configuration, is coordinated to the output of the respective cigarette-producing machine, and is mounted adjacent thereto; and directly recycling to the cigarette-producing machine a uniform stream of tobacco recovered from the recovery apparatus, which is provided with a storage means for collecting variable quantities of imperfect cigarettes.

As a consequence of the inventive association of a dedicated recovery apparatus for each cigarette-producing machine, it is possible to recover the tobacco immediately after the imperfect cigarettes have been separated-out, i.e. without additional transport and storage effort or expenditure. Thus, not only is a drying-out of the tobacco avoided, but also damage to the quality of the tobacco during intermediate transport and storage is avoided. Imperfect cigarettes can also be accumulated in various quantities, pursuant to the present invention within the recovery apparatus, but the stream of recovered tobacco is returned relatively uniformly along with the fresh tobacco to the cigarette-producing machine. In this way, fluctuations in quality are avoided.

Since space is very limited with cigarette-producing machines, and the accessibility to such machines must not be adversely affected by the inventive recovery apparatus, an underlying requirement of the inventive apparatus is that it requires little space and is easy to mount on existing cigarette-producing machines.

This requirement, and the aforementioned objectives, are realized with the apparatus of the present invention, which is characterized primarily by: a rotary conveyer that is disposed below an elevator of the cigarette-producing machine, with the rotary conveyer having a bowl-shaped receiving chamber for receiving the imperfect cigarettes from the elevator; a system of rollers for receiving from the rotary conveyer separated imperfect cigarettes that in the rotary conveyer are aligned in the direction of transport and are transported tangentially therefrom, with the paper casings of the cigarettes being cut open in the system of rollers; and a screen conveyer that is disposed downstream of the system of rollers and in which the tobacco is separated from the cut-open paper casings and from any filters that are present and is subsequently continuously supplied to the spreader of the cigarette-producing machine.

The use of a basically known rotary conveyer having a bowl-shaped receiving chamber provides the possibility of receiving the imperfect cigarettes in a type of storage means, even where the cigarettes arrive in varying quantities, and subsequently aligning the cigarettes axially to the direction of transport, accompanied by simultaneously evening-out the flow, in such a way that the cigarettes can be supplied to a similarly known roller system that is disposed downstream thereof for opening the paper casings. Since the rotary conveyer on the one hand requires little floor space, and on the other hand has a sufficiently long orienting track, it can also be mounted without difficulty on existing cigarette-producing machines. The separation of tobacco from the paper casings that are slit open in the roller system and possibly from filters that are present, is effected pursuant to the present invention in a screen conveyer that continuously supplies the recovered tobacco to the fresh tobacco in the cigarette-producing machine. In this way, the recovered tobacco immediately, and in a uniform manner, reaches the supply stream of fresh tobacco for the cigarette-producing machine, so that the quality of the tobacco is not degraded.

Pursuant to a further feature of the present invention, the rotary conveyer can be embodied as an apparatus that has a cylindrical receiving hopper with a controlled conical lift and also has a horizontally encircling transport ring, with this apparatus being provided for transporting away the cigarettes, which are aligned via baffles, by means of a second transport ring that is disposed at an incline next to the first transport ring. Alternatively, the rotary conveyer could also be embodied as a conical vibrating conveyer bowl that has a helically rising conveyer track.

Pursuant to one preferred specific embodiment of the inventive apparatus, baffle plates that extend parallel to one another in the tangential outlet means of the rotary vibrating bowl are provided for dividing the separated cigarettes into several rows that are disposed parallel to one another. If, pursuant to a further feature of the present invention, these baffle plates have different heights, which decrease in a direction toward the outer side, the possibility is provided for conducting and discharging toward the outer side cigarettes that are stuck together and that would have led to a disruption in the subsequent system of rollers.

Pursuant to a preferred specific embodiment of the present invention, the bottom in the outlet means of the rotary conveyer is provided with holes, and the space below this bottom is connected via a collector means and at least one transport mechanism with the fresh tobacco supply means for the cigarette-producing machine. In this way, loose tobacco that has been separated from the aligned cigarettes is conveyed to the fresh tobacco supply for the cigarette-producing machine, so that this loose tobacco does not contaminate the mechanisms for opening the cigarettes. The loose tobacco can be supplied directly to the fresh tobacco supply, or can be fed to a conveyer means for moving material upwardly, which raising conveyer means returns the tobacco from the slit-open cigarettes to the cigarette-producing machine.

In one preferred specific embodiment of the present invention, a conveyer belt that is moistened with water is disposed between the outlet means of the rotary conveyer and the system of rollers; the transport speed of this conveyer belt is preferably greater than the transport speed of the rotary conveyer. With the aid of such a conveyer belt, the separated and aligned cigarettes that are coming from the rotary conveyer are efficiently supplied to the roller system that is disposed downstream thereof and that pursuant to the present invention has at least one slitting roller that is provided with rotating blade rings. The vee shaped blade rings of this slitting roller can either be disposed parallel to each other along the axis of rotation of the rollers, or can be in the form of a continuous helix over the entire length of the roller. Both cases assure that each cigarette casing is reliably slit open without, however, thereby damaging the tobacco in the cigarettes.

In order to be able to dispose the screen conveyer, which is used to separate the tobacco from the paper casings and any filters that are present, above the cigarette-producing machine, not only to save flow space but also to be able to supply the recovered tobacco without the need for an additional mechanism that requires space, and to be able to supply the tobacco merely by the force of gravity, it is furthermore proposed pursuant to the present invention to dispose between the system of rollers and the screen conveyer a conveyer means for moving material upwardly. This raising conveyer means is preferably embodied as an elevator that has a belt that is provided with projections. Such a belt provides a protective and gentle transport effect, so that the tobacco is not subjected to stress during the raising operation, and its long fibers are not destroyed. The screen conveyer is preferably operated by a crank drive that has a relatively large stroke and low frequency, and which discharges the recovered tobacco directly into the stream of the fresh tobacco supply via the force of gravity.

Since the inventive apparatus must work without operating personnel, it is finally proposed pursuant to the present invention that sensors be installed to monitor the flow of cigarettes and tobacco, and that emit audible and/or visual signals and turn off the apparatus if it is blocked or otherwise overloaded.

Further specific features of the present invention will be described in detail subsequently.

DESCRIPTION OF PREFERRED EMBODIMENTS

Referring now to the drawings in detail, the cigarette-producing machine 1, which is illustrated in dot-dash lines in FIG. 1, is provided with an elevator 2 for defective or imperfect cigarettes that have been separated out in the cigarette-producing machine 1, for example because they have not been completely filled with tobacco or because the filter is missing or has been incorrectly applied. Such mistakes in production occur in particular when the machine is started up. The tobacco that is contained in these imperfect cigarettes has a not inconsiderable value, and should therefore be recovered.

To recover this tobacco, there is disposed below the elevator 2 of the cigarette-producing machine 1 a rotary conveyer one specific embodiment of which is illustrated in FIGS. 2 to 7. This rotary conveyer comprises a conical vibrating bowl 4 to which oscillating vibrations are electromagnetically imparted. As a result, the cigarettes that are in the cup-shaped receiving chamber 4*a* are conveyed upwardly on a helically rising track 4*b*, whereby the cigarettes are at the same time aligned in such a way that their longitudinal direction is disposed in the conveying direction. The accordingly aligned cigarettes leave the vibrating bowl 4 approximately in a tangential direction via an outlet means 5, which is shown in greater detail in the enlarged views of FIGS. 5 to 7.

FIG. 5, in dot-dash lines, shows various cigarettes Z that as a result of the vibrations of the vibrating bowl 4 move in the direction of the arrow indicated in FIG. 5. In so doing, the cigarettes Z arrive in the region of the baffle plates 5*a*, which extend parallel to one another and split the separated cigarettes Z into several side by side rows. This enhances the separation effect of the rotary conveyer 3.

As can be seen in particular in FIG. 7, the baffle plates 5*a* have varying heights that decrease in a direction toward the outer side of the outlet means 5. As a result, cigarettes or filters that are stuck together and that cannot enter the spaces between individual baffle plates 5*a* are discharged to the side and outwardly; this prevents such stuck-together cigarettes from clogging the subsequent transport mechanisms or from otherwise disrupting the flow of cigarettes. In addition, it is possible to remove clumps of cigarettes disposed on the baffle plates 5*a* via a stream of air or a belt that is provided with projections. To facilitate illustration, such auxiliary means have not been shown in the drawings.

Figure 3:
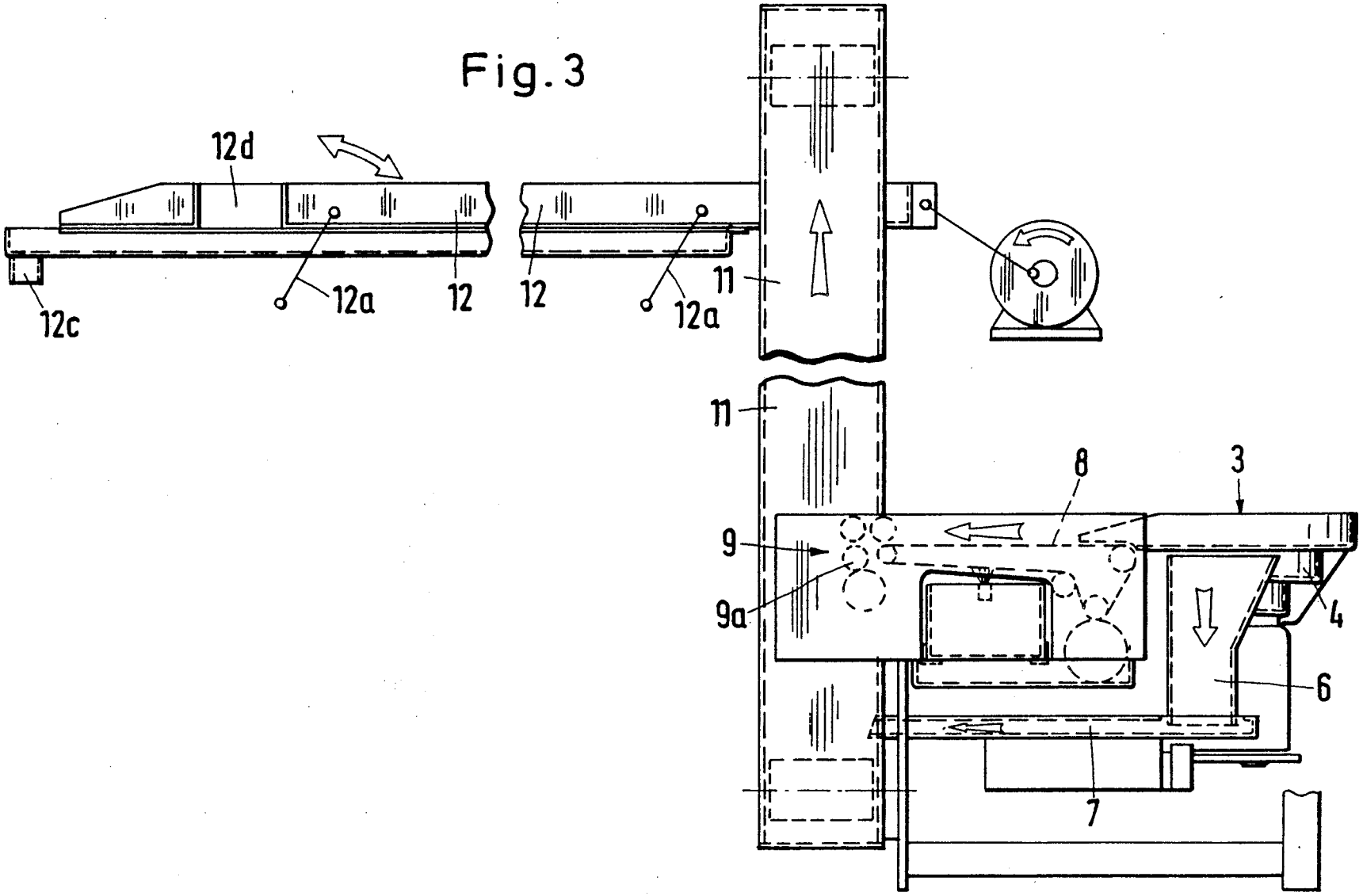
FIG. 3 is a front view of the apparatus of FIG. 2.

The tobacco that has dropped out during transport of the cigarettes Z in the rotary conveyer 3, and that is disposed on the spirally rising conveyer means 4*b* of the vibrating bowl 4, is separated out in the outlet means 5 of the rotary conveyer 3 via holes 5*b*. As a result of these holes 5*b*, the loose tobacco falls through and, as shown in FIG. 3, arrives in a collector means 6 that in the illustrated embodiment guides the tobacco to a transport mechanism that is in the form of a vibrating conveyer 7. This vibrating conveyer 7 could feed the loose tobacco directly to the fresh tobacco inlet of the cigarette-producing machine 1. However, in the illustrated embodiment various other intermediate transport mechanisms are provided.

Figure 2:
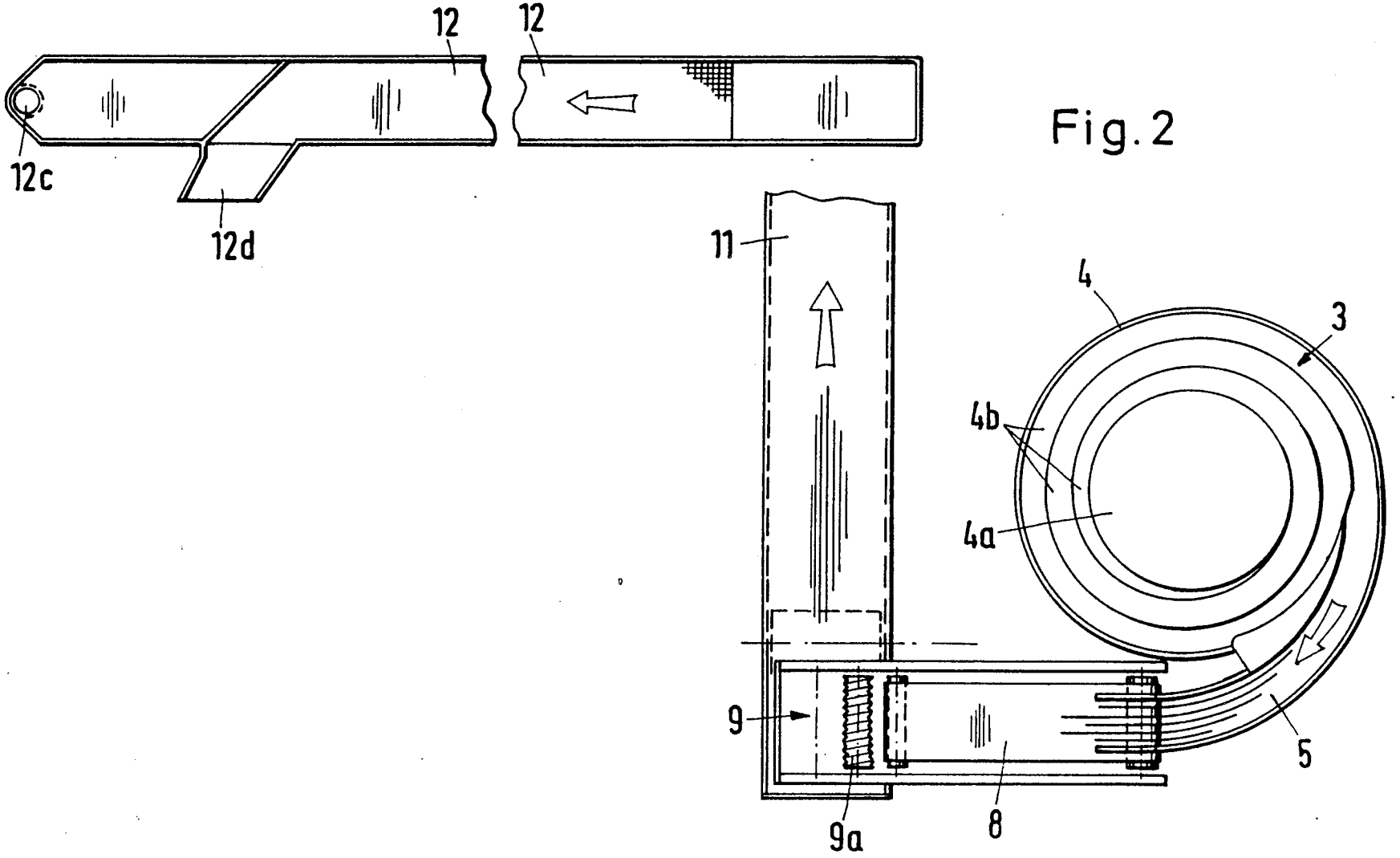
FIG. 2 is an enlarged plan view of one exemplary embodiment of the inventive apparatus.

The cigarettes Z that leave the outlet means 5 of the rotary conveyer 3 pass onto a conveyer belt 8 that is moistened with water and that can be best seen in FIGS. 2 and 3. This conveyer belt 8 preferably has a greater conveying speed than the conveying speed of the rotary conveyer 3, thereby enhancing the axial alignment of the cigarettes Z. Since the loose tobacco has already been carried off via the holes 5*b* in the outlet means 5, this loose tobacco cannot accumulate on the moistened conveyer belt 8.

The cigarettes Z are now supplied to a roller system 9 that has at least one slitting roller 9*a* which is provided with circumferential blade rings. The blade rings of this slitting roller 9*a* can either be disposed, as individual vee rings, parallel to each other along the axis of rotation of the roller, or can be embodied as a helical slitting blade that extends over the entire length of the roller. In either case, the paper casings or wrappings of the cigarettes, which enter the system 9 of rollers in an axially oriented manner, are safely and carefully slit open without damaging the long strings or pieces of tobacco.

Figure 4:
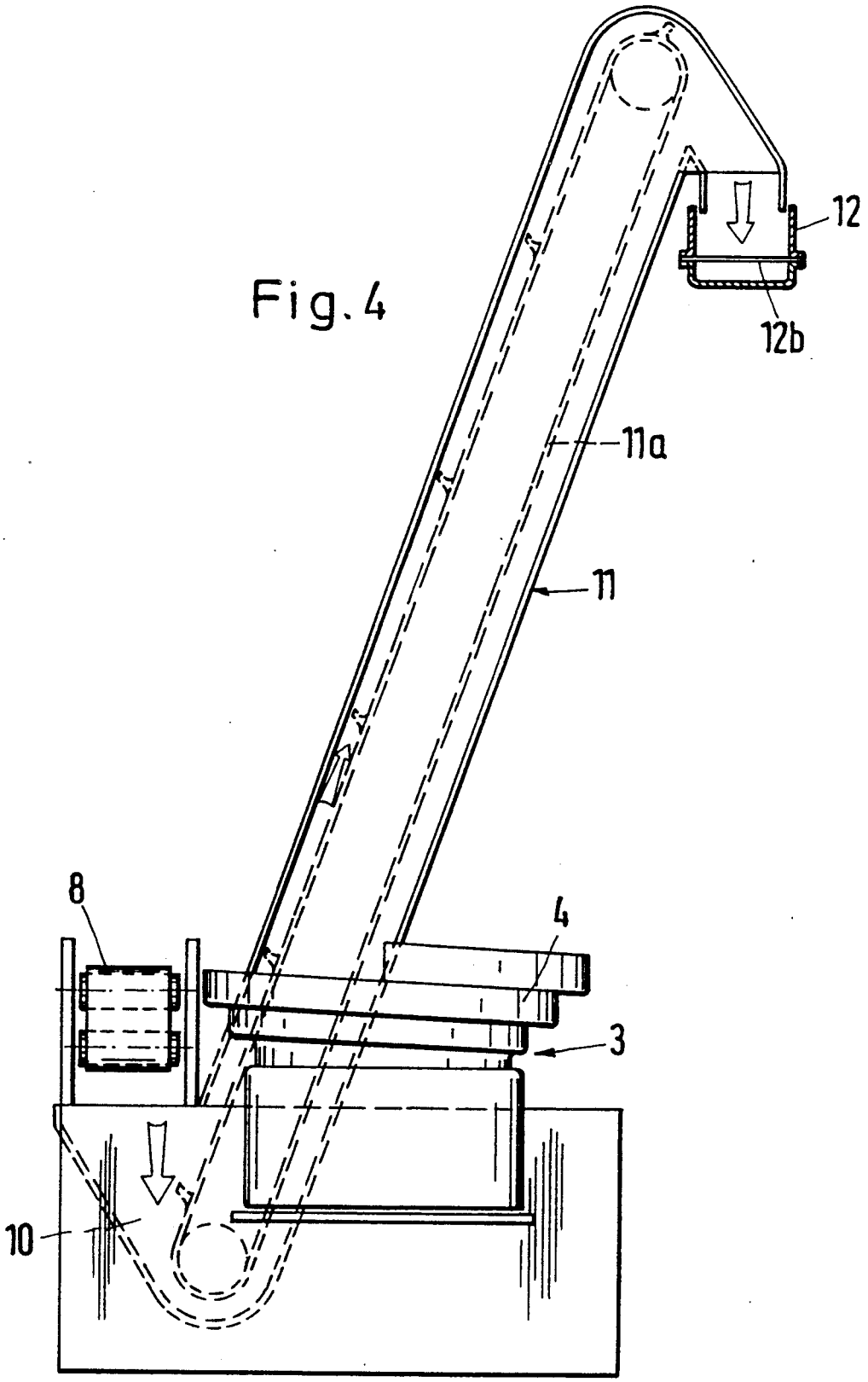
FIG. 4 is an end view of the apparatus of FIGS. 2 and 3.

As shown in FIG. 4, the cigarettes, the paper casings of which have been opened, fall into the receiving hopper 10 of a conveyer means 11 for moving material upwardly. In the illustrated embodiment this raising conveyer means 11 is provided with a belt 11*a* that has projections, with such a belt 11*a* resulting in a careful transport of the slit-open cigarettes, which at the same time are conveyed upwardly to such an extent that they reach a screen conveyer 12 that extends above the cigarette-producing machine 1. This screen conveyer 12 is preferably mounted on pivot members 12*a* and is operated via a crank drive (FIG. 3) with a relatively large stroke and low frequency, so that the tobacco is separated from the slit-open paper of the paper casings along a short stretch. The tobacco falls through a screen 12*b* (see FIG. 4) and, in the lower portion of the screen conveyer 12, reaches an outlet means 12*c* that introduces the recovered tobacco directly into the fresh tobacco, which is supplied to the cigarette-producing machine 1. Thus, a continuous supply of the recovered tobacco is effected to the cigarette-producing machine 1. The paper from the cigarette casings, as well as filters that might be present, and which paper and filters are conveyed in the screen conveyer 12 above the screen 12*b*, exit the upper portion of the screen conveyer 12 out of a lateral outlet means 12*d* and are withdrawn in a suitable manner.

Since the rotary conveyer 3 is provided with a bowl-shaped receiving chamber 4*a*, it represents a storage means that can without difficulty receive various quantities of cigarettes, i.e. cigarettes that come in large or small batches from the cigarette-producing machine. These cigarettes are carefully moved in a circular manner, whereby at the same time a stream of cigarettes is formed that rises from below along the helically extending track means 4*b*. In so doing, jamming and clogging is prevented, so that the cigarettes are aligned in the direction of transport when they reach the outlet means 5 of the rotary conveyer 3. At the same time, while requiring little ground space, such a rotary conveyer 3 provides a long sorting path that in addition results in an evening out of the cigarette accumulation, so that the tobacco that is subsequently released from the cigarettes can be supplied directly and as a continuous stream to the fresh tobacco of the cigarette-producing machine 1. The previously described components of the inventive apparatus result in a space-saving recovery apparatus that is coordinated with the output of the respective cigarette-producing machine 1, so that the inventive apparatus can be installed directly on such a machine without obstructing service or maintenance thereof.

The present invention is, of course, in no way restricted to the specific disclosure of the specification and drawings, but also encompasses any modifications within the scope of the appended claims.

What we claim is:

1. In an apparatus for recovering tobacco from imperfect cigarettes that are separated-out downstream of a cigarette-producing machine and are supplied to said recovery apparatus to open the paper casings of said cigarettes as well as to separate the tobacco from the paper pieces and from any filters that are present, with the tobacco recovered from said apparatus being returned, together with fresh tobacco, to said cigarette-producing machine, the improvement comprising:

a rotary conveyer disposed below an elevator of said cigarette-producing machine, with said rotary conveyer having a bowl-shaped receiving chamber for receiving said imperfect cigarettes from said elevator;

a system of rollers for receiving from said rotary conveyer separated imperfect cigarettes that in said rotary conveyer are aligned in the direction of transport and are transported tangentially therefrom, with said paper casings of said cigarettes being cut open in said roller system; and a screen conveyer that is disposed downstream of said roller system and in which said tobacco is separated from said cut-open paper casings, and from any filters that are present, and is subsequently continuously supplied to said fresh tobacco for said cigarette-producing machine.

2. An apparatus according to claim 1, in which said rotary conveyer is embodied as a device that has a cylindrical receiving hopper with a controlled conical lift and also has a horizontally encircling first transport ring, with said device, for transporting away cigarettes that have been aligned via baffles, furthermore being provided with a second transport ring that is disposed at an incline adjacent to said first transport ring.

3. An apparatus according to claim 1, in which said rotary conveyer is embodied as a conical vibrating conveyer bowl that has a helically rising conveyer means.

4. An apparatus according to claim 3, in which said rotary conveyer is provided with a tangential outlet means in which are disposed baffle plates that extend parallel to one another and serve to divide said separated cigarettes into several side-by-side rows.

5. An apparatus according to claim 4, in which said baffle plates have different heights that decrease in a direction toward an outer side.

6. An apparatus according to claim 1, in which outlet means of said rotary conveyer includes a base that is provided with holes that lead to a space disposed below said base; and which includes collector means and at least one transport mechanism for connecting said space below said base to said fresh tobacco supply for said cigarette-producing machine.

7. An apparatus according to claim 1, which includes a conveyer belt, which is moistened with water, disposed between outlet means of said rotary conveyer and said roller system.

8. An apparatus according to claim 7, in which said conveyer belt has a transport speed that is greater than the transport speed of said rotary conveyer.

9. An apparatus according to claim 1, in which said roller system has at least one slitting roller that is provided with circumferential blade ring means.

10. An apparatus according to claim 9, in which said blade ring means comprises vee shaped blade rings that are disposed parallel to each other along the axis of rotation of said roller.

11. An apparatus according to claim 9, in which said blade ring means comprises a slitting blade that extends helically over the entire length of said roller.

12. An apparatus according to claim 1, which includes disposed between said roller system and said screen conveyer a conveyer means for moving material upwardly.

13. An apparatus according to claim 12, in which said material-raising conveyer means is an elevator having a belt that is provided with projections.

14. An apparatus according to claim 1, which includes, for operating said screen conveyer, a crank drive having a relatively large stroke and low frequency.

15. An apparatus according to claim 1, which includes sensor means for monitoring the flow of cigarettes and tobacco, with said sensor means emitting audible and/or visual signals and shutting off said apparatus if a blockage or other overload is encountered.

* * * * *